US007128585B2

(12) United States Patent
Evilsizer

(10) Patent No.: US 7,128,585 B2
(45) Date of Patent: Oct. 31, 2006

(54) ELONGATED ELECTRICAL OUTLET

(75) Inventor: Brian Evilsizer, 2920 South Bay Dr., Westlake, OH (US) 44145

(73) Assignee: Brian Evilsizer, Westlake, OH (US)

( * ) Notice: Subject to any disclaimer, the term of this patent is extended or adjusted under 35 U.S.C. 154(b) by 115 days.

(21) Appl. No.: 11/143,533

(22) Filed: Jun. 2, 2005

(65) Prior Publication Data

US 2005/0221646 A1 Oct. 6, 2005

Related U.S. Application Data

(63) Continuation of application No. 10/789,232, filed on Feb. 27, 2004, now abandoned.

(51) Int. Cl.
*H01R 25/00* (2006.01)

(52) U.S. Cl. ..... 439/120; 439/209; 439/216

(58) Field of Classification Search ..... 439/120, 439/209, 214, 216, 215, 121, 122, 111, 113, 439/211

See application file for complete search history.

(56) References Cited

U.S. PATENT DOCUMENTS

| | | | | | |
|---|---|---|---|---|---|
| 1,812,956 | A | | 7/1931 | Howk | |
| 2,023,004 | A | | 12/1935 | Clayton | |
| 2,042,105 | A | | 5/1936 | Kelley | |
| 2,076,558 | A | | 5/1937 | Hartman et al. | |
| 2,190,196 | A | | 2/1940 | Semenyna | |
| 2,267,080 | A | * | 12/1941 | Clayton | 307/12 |
| 2,279,383 | A | | 4/1942 | Von Gehr | |
| 2,312,580 | A | * | 3/1943 | O'Brien | 439/216 |
| 2,313,452 | A | * | 3/1943 | O'Brien | 439/216 |
| 2,319,375 | A | | 5/1943 | Von Gehr | |
| 2,415,602 | A | | 2/1947 | Monaco | |
| 2,561,031 | A | | 7/1951 | Murphy | |
| 2,579,854 | A | | 12/1951 | Perkins | |
| 2,617,849 | A | | 11/1952 | Wright et al. | |
| 2,669,632 | A | | 2/1954 | Hammerly | |
| 2,855,578 | A | | 10/1958 | Hirsch | |
| 2,899,668 | A | * | 8/1959 | Gribben | 439/115 |
| 3,003,132 | A | * | 10/1961 | Johnson et al. | 439/216 |
| 3,059,204 | A | * | 10/1962 | Johnson | 439/95 |
| 3,081,442 | A | | 3/1963 | Platz | |
| 3,089,042 | A | | 5/1963 | Hickery et al. | |
| 3,175,031 | A | | 3/1965 | Reiner | |
| 3,239,795 | A | * | 3/1966 | Verrone | 439/121 |
| 3,262,083 | A | | 7/1966 | Gooding | |
| 3,273,103 | A | * | 9/1966 | Ericson | 439/43 |
| 3,503,032 | A | | 3/1970 | Routh et al. | |
| 3,529,274 | A | | 9/1970 | Routh | |
| 3,598,900 | A | | 8/1971 | Drake | |
| 3,603,918 | A | | 9/1971 | Woertz | |
| 3,707,061 | A | | 12/1972 | Collette et al. | |

(Continued)

FOREIGN PATENT DOCUMENTS

FR 2423898 4/1978

(Continued)

*Primary Examiner*—Ross Gushi
(74) *Attorney, Agent, or Firm*—Watts Hoffmann Co L.P.A.

(57) ABSTRACT

A receptacle for receiving an electrical plug is disclosed. The receptacle includes a plurality of channels which extend generally for the length of the receptacle. The channels include conductors where at least one of the conductors accommodates the smaller prong on a polarized plug. At least one of the conductors is in constant contact with a power source while at least one conductor is controlled by a switch. A receptacle of the invention is normally adapted to baseboards to allow a user to insert an electrical plug in either a constant "hot" connection or a switched controlled connection for generally the length of the baseboard.

24 Claims, 4 Drawing Sheets

U.S. PATENT DOCUMENTS 3,721,762 A 3/1973 Gooding
3,786,171 A 1/1974 Shira
3,806,858 A * 4/1974 Larsile ..... 439/216
3,855,413 A 12/1974 Baillie
3,890,459 A 6/1975 Caveney
3,996,415 A 12/1976 Provorse
4,080,766 A 3/1978 Jastrabek
4,108,523 A * 8/1978 Bolis ..... 439/116
4,190,309 A 2/1980 Glass
4,305,430 A 12/1981 Svensson
4,423,284 A 12/1983 Kaplan
4,477,694 A 10/1984 Kohaut
4,479,687 A 10/1984 Humphreys et al.
4,508,400 A 4/1985 Herbert
4,534,147 A 8/1985 Cristell
4,589,449 A 5/1986 Bramwell
4,629,826 A 12/1986 Thomas
4,690,474 A 9/1987 Smart et al.
4,723,580 A 2/1988 Trautwein
4,775,328 A * 10/1988 McCarthy ..... 439/211
4,814,941 A * 3/1989 Speet et al. ..... 361/622
4,825,540 A * 5/1989 Kelly ..... 29/861
4,875,871 A * 10/1989 Booty et al. ..... 439/209
4,952,164 A * 8/1990 Weber et al. ..... 439/215
5,001,877 A 3/1991 Edwards
5,052,937 A 10/1991 Glen
5,055,067 A 10/1991 Field
5,089,667 A 2/1992 Goussin et al.
5,096,753 A 3/1992 McCue et al.
5,146,723 A 9/1992 Greenwood et al.
5,183,406 A * 2/1993 Glen ..... 439/120
5,236,370 A * 8/1993 King et al. ..... 439/215
5,274,972 A 1/1994 Hansen
5,353,571 A 10/1994 Berdan et al.
5,357,053 A 10/1994 Manaras
5,433,048 A 7/1995 Strasser
5,444,954 A 8/1995 Anderson
5,582,520 A 12/1996 Doudon
5,595,495 A * 1/1997 Johnson et al. ..... 439/215
5,598,681 A 2/1997 DiGianni
5,603,621 A 2/1997 Elmouchi
5,675,194 A * 10/1997 Domigan ..... 307/147
5,694,726 A 12/1997 Wu
5,759,051 A 6/1998 Cancellieri et al.
5,901,514 A 5/1999 Wolfe
5,957,414 A 9/1999 Perrignon de Troyes
6,021,619 A 2/2000 Mansson
6,084,180 A 7/2000 DeBartolo, Jr. et al.
6,202,380 B1 3/2001 Trutwin et al.
6,220,880 B1 * 4/2001 Lee et al. ..... 439/214
6,644,988 B1 * 11/2003 Healy ..... 439/120
6,890,219 B1 * 5/2005 Mayer et al. ..... 439/679

FOREIGN PATENT DOCUMENTS

GB 839347 6/1960
WO WO 87/01524 3/1987

* cited by examiner

ELONGATED ELECTRICAL OUTLET

CROSS-REFERENCE TO RELATED APPLICATION

The present invention is a continuation of U.S. application Ser. No. 10/789,232 filed on Feb. 27, 2004 now abandoned and entitled "Elongated Electrical Outlet" which is incorporated herein in its entirety by reference.

FIELD OF THE INVENTION

The present invention relates to electrical components and, more particularly, to a baseboard having a continuous electrical outlet.

BACKGROUND

Baseboard molding serves several architectural functions. One of the functions is to provide concealment of imperfections created at the floor and wall joint. Prior art also shows the use of the baseboards for concealing conduits.

U.S. Pat. No. 6,191,363 to Samuels teaches a conduit, concealing baseboard molding for concealing and organizing conduits such as electrical wiring and cables. The molding includes a back plate which has a several conduit stalls for receiving conduits.

U.S. Pat. No. 5,901,514 to Wolfe discloses a structural wall apparatus having building panels with inner and outer metal skin spaced by an insulating core of foamed polymer. Each panel has an interlocking edge with a metal line tongue to allow for interconnection of the panels. Further, the panels include a reinforcing member connected to the metal skin with a strengthening flange portion. Fasteners pass through the interconnecting grooves and flanges to facilitate connection. A "C" frame member is included with the apparatus for receiving a shroud for concealing electrical conduits or other conduits which may be necessary to install through a building near the floor or foundation. Specifically, the '514 patent is directed to a baseboard or foundational anchor shroud through which electrical or communication conduit may be passed.

U.S. Pat. No. 6,084,180 to DeBartolo teaches a multichannel duct for enclosing conductors, cables wires, power lines, communication lines and the like. The duct includes an elongated base with an elongated divider separating the base into two channels. A pair of elongated covers overlay the channels and an inner layer overlays one of the channels. The divider and inner cover may be detached from the base by a frangible seam for converting the two channel ducts to a single channel duct.

U.S. Pat. No. to Gooding discloses an electrical raceway that includes a retaining clip and cover member that are formed with extrusions which provide wire receiving channels to contain different types of wires. An outlet is provided adjacent to the raceway and a cover fits over the outlet and adjacent portions of the raceway.

U.S. Pat. No. 2,561,031 to Murphy teaches an electrical connection device having a longitudinal wire conduit with one or more plug receptacles on the conduit system and electrically connected with wires within the conduit.

U.S. Pat. No. 2,190,196 to Semenyna discloses an electric molding structure providing electrical outlets a several locations along its length. The molding structure may include corner and angle members having electrical conductors which may be coupled together which continues the circuit without the need for tools or solder connections.

In view of the cited art, there is a need for a baseboard having a raceway that can receive an electrical plug at any point along a baseboard.

SUMMARY OF THE DISCLOSURE

Disclosed is a baseboard having an integrated electrical connection for receiving an electrical plug. In a preferred embodiment, the baseboard is constructed of extruded plastic. However, the baseboard may be constructed from wood or solid plastic fabrications. The baseboard can take on many designs to accommodate different structural and aesthetic considerations.

In one embodiment, the baseboard includes channels each of which house a conductor. Preferably, two types of conductors are employed. The first type is a polarized conductor that includes slots along its length which accommodate the smaller prong on a polarized plug. The second type of conductor is a non-polarized conductor which consists of a continuous raceway and can accept a prong of a plug at any point along its length. The channels on the baseboard can include either of the two types of conductors. The preferred embodiment is a three-channel system in which the top channel and bottom channel each include a conductor of the polarized type while the middle channel includes a conductor of the non-polarized type.

In the preferred embodiment, the polarized conductor in the upper channel is in a constant "hot" state that is always connected to the power source. The middle channel houses a non-polarized neutral conductor and the bottom channel houses a polarized conductor that is switch controlled. In this configuration, a two-prong plug can be plugged into the top two channels where the smaller prong is inserted into the top channel that includes the polarized conductor and the larger prong is inserted into the middle channel that has the non-polarized conductor. Once plugged in, electricity is continuously available for the electrical device. When the plug is rotated 180° and the smaller prong is inserted into the bottom channel having a polarized conductor and the larger is again inserted into the middle channel, electricity will not be available for a device until the switch controlling the flow of electricity through the conductor in the bottom channel is activated.

The baseboard further includes hollow regions that extend for the length of the baseboard. These hollow regions can be used as conduits for other utility cable such as but not limited to telephone, cable and/or network cable.

In another embodiment, the channels can be enclosed in the baseboard and act as conduits for the baseboard electrical conductors in room locations where the access to electricity is not preferred such as around a door, window or other obstacle that interferes with the straight continuous system. In this instance, the channels are closed to form conduits to carry the conductor to a point at which they are once again exposed to accept an electrical plug.

In another embodiment, guards are employed to cover the channels and to prevent debris from entering the channels. The guards are preferably rubber but may be comprised of any material as apparent to those of ordinary skill in the art. The baseboard may have as many guards as it does channels (i.e., one guard per channel) or the guard may be one-piece construction having slits at the opening of the channels. Therefore, the one-piece guard will have as many slits as channels in the baseboard.

In yet another embodiment, the baseboard includes five channels. The five channel configuration allows for the use of a three prong, polarized plug. The top and bottom channels each include a polarized conductor while the second and fourth channels each include a conductor to accommodate the neutral prong on the three-prong plug and the middle or third channel includes a non-polarized conductor. In the five channel system, for a constant electrical connection, the three prongs are inserted into the top three channels where the top channel accommodates the smaller prong on the polarized plug. Where a switched connection is desired, the plug is rotated 180° so that the prongs are inserted into the bottom three channels housing conductors. The bottom channel accommodates the smaller prong on the polarized plug.

In yet another embodiment, the baseboard includes a kick switch and lighting. A kick switch may be installed at or near door openings so that when a person enters the door they are able to kick the switch with their foot to turn on a light that is plugged into the switched conductor. Other options include adding light within the baseboard to provide wall lighting and the like. The concept of the present invention may also be employed in electrical receptacles of any length. Such a receptacle my include a plug for insertion into an electrical outlet. This type of receptacle is similar to multi-outlet plug adaptors, however, the device according to the present invention includes a continuous raceway which can receive a plug at any point along its length.

In yet another embodiment, the baseboard can be modified to be used as a portable power strip or as a power strip installed at a specific location. One such instance is a power strip for use above a sink in either a bathroom or kitchen. The power strip may be installed and may include lights at any point along its length. In other embodiments, it may be necessary to have a surge protector and/or Ground Fault Interrupt (GFI) included in either the baseboard or power strip applications between the electrical power supply and the conductors. The surge or GFI may be employed to protect a small section of the modified baseboard or it can be installed to protect an entire room by protecting the entire baseboard raceway. This eliminates the need for a surge protector or GFI protector at every plug.

It is to be understood that both the foregoing general description and the following detailed description are exemplary, but are not restrictive, of the invention.

DETAILED DESCRIPTION

Figure 1:
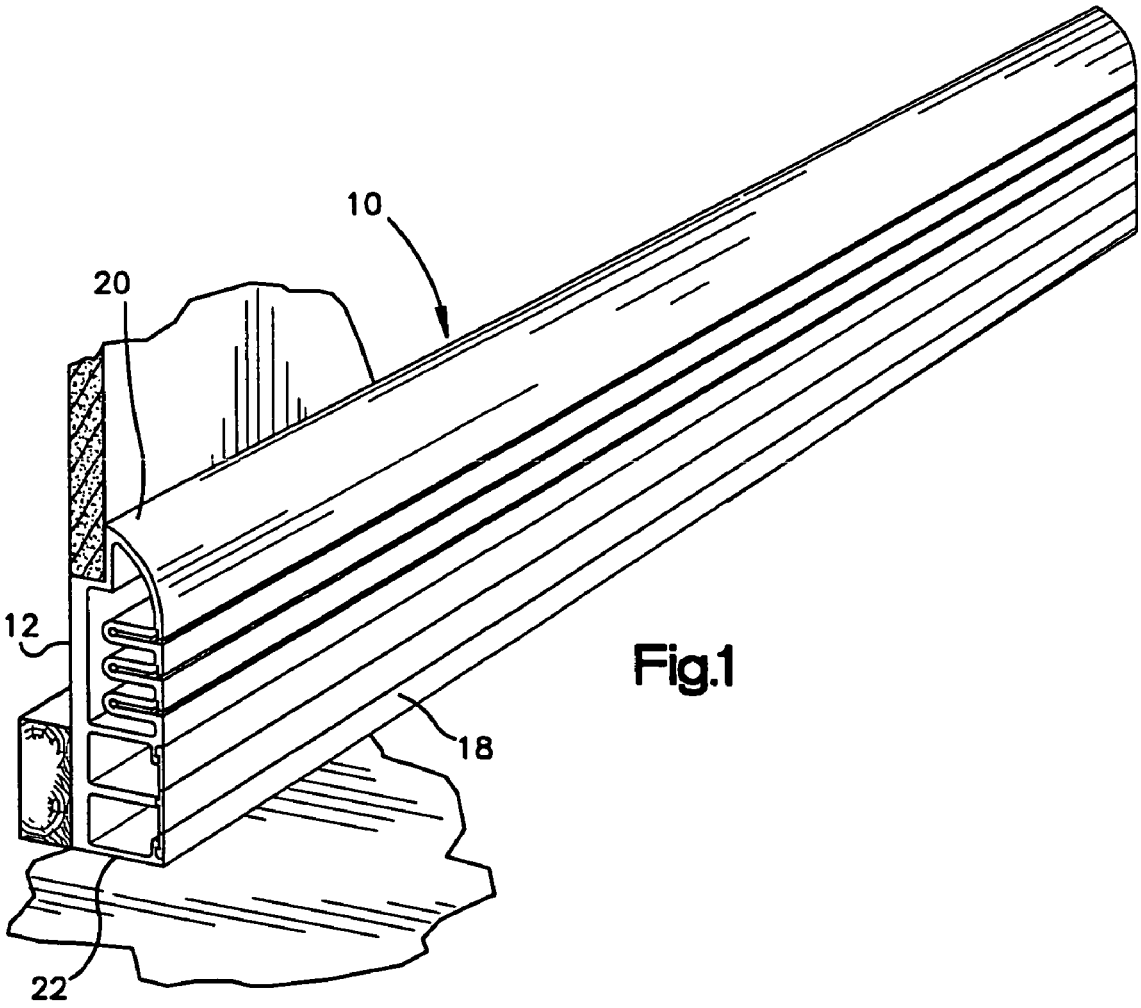
FIG. 1 is a perspective view of an electrical baseboard according to the present invention.

Turning now to the figures, FIG. 1 illustrates a baseboard 10 including the features of the present invention. The baseboard 10 includes a back plate 12 which can be secured to a wall 14 or wall studding 16, best shown in FIG. 2. The baseboard 10 is extruded from a plastic material. The back plate 12 includes an upper extension 20 and a lower extension 22 which extend away from the back plate 12 in a generally perpendicular direction. The extensions 20, 22 may take on a variety of designs. For instance, the upper extension 20 may be curved for aesthetic reasons. Additionally, the upper extension 20 may include an "L" shaped design, as illustrated, to accommodate a wall covering such as dry wall or paneling. The lower extension 22 normally is of a straight design and runs generally parallel to the floor 15.

Referring in particular to FIGS. 2–4*a*, the extensions 20, 22 each connect to a front plate 18. The front plate 18 runs generally parallel to the back plate 12 and connects the upper extension 20 to the lower extension 22. The front plate 18, back plate 12 and extensions 20, 22 are extruded as one piece creating a hollow cavity between the front plate 18 and the back plate 12. In addition, the front plate 18 has extruded therein channels or depressions 24, 26, 28 which extend into the hollow portion of the baseboard 10 in a direction towards the back plate 12. The channels 24, 26, 28 each include a semi-circular portion 24*a*, 26*a*, 28*a* at the termination of the channels each of which has a diameter larger than the width of the respective channel. These semi-circular portions 24*a*, 26*a*, 28*a* are used as a means of holding in place conductors 30, 32, 34.

The conductors 30, 32, 34 are made of a conductive metal and supply electrical current to the channels 24, 26, 28. The conductors are designed to accommodate polarized plugs which follow the convention in that the larger prong is connected to the phase neutral wire while the smaller prong is connected to a "hot" wire. That being said, two different configurations of conductors are employed in the present baseboard 10. The first configuration of conductor is the design of conductor 30 which is used in conjunction with channel 24 and accepts the smaller prong on the polarized plug. Therefore, for clarity, this conductor will be referred to as a polarized conductor. The polarized conductor is shown in FIG. 4*a*. Conductor 30 includes a semi-circular end 80 which is retained by the respective semi-circular end 24*a* of the channel 24. Extending away from the semi-circular end 80 of the conductor 30 is a upper arm 82. A lower arm 84 likewise extends away from the semi-circular end 80 of the conductor 30 and runs generally parallel to the upper arm 82. The diameter of the semi-circular end 80 is greater than the distance between the upper arm 82 and lower arm 84. The distance between the lower arm 84 and upper arm 82 is such that the space can accommodate a smaller prong 102 on a polarized plug 100.

The upper arm 82 includes flanges 86 at the end distal to the semi-circular portion 80. The flanges 86 are cut out from the upper arm 82 of the conductor 30. The flanges 86 are then bent downward to meet the lower arm 84. This configuration produces slots each of which is defined by the edges of adjacent flanges 86, the outer edge 82*a* of the upper arm 82 to the top and the outer edge 84*a* of the lower arm 84 at the bottom. The slot is designed to be of size to accommodate the smaller prong 102 of the polarized plug 100. The outer edges 82*a*, 84*a* of the extensions 82, 84 include a bevel which aids in accepting the prong 102 of the plug 100. In the illustrated design, the polarized conductor 30 is installed in the upper channel 24. Additionally, conductor 34 housed by channel 28 employs the polarized design as described in relation to conductor 30.

Channel 26 houses conductor 32 which is of the second type and accommodates the larger prong of a polarized plug. Therefore, for the sake of clarity, this type of conductor will be referred to as a non-polarized conductor. As with the conductor 30, the conductor 32 includes a semi-circular region 80 which includes an upper arm 92 and a lower arm 84. The lower arm 84 is of the same design as described above in relation to the conductor 30, however, the upper arm 92 does not include flanges. The upper arm 92 is a mirror of the lower arm 84. Each arm 92 and 84 include a bevel at an end distal to the semi-circular end 80. Again, the diameter of the semi-circular end 80 is larger than the distance between the arms 84, 92. This conductor 32 is housed in the middle channel 26 and is adapted to accepts the larger prong 104 of a polarized plug 100. Other arrangements of polarized, non-polarized conductors is hereby contemplated.

Figure 4:
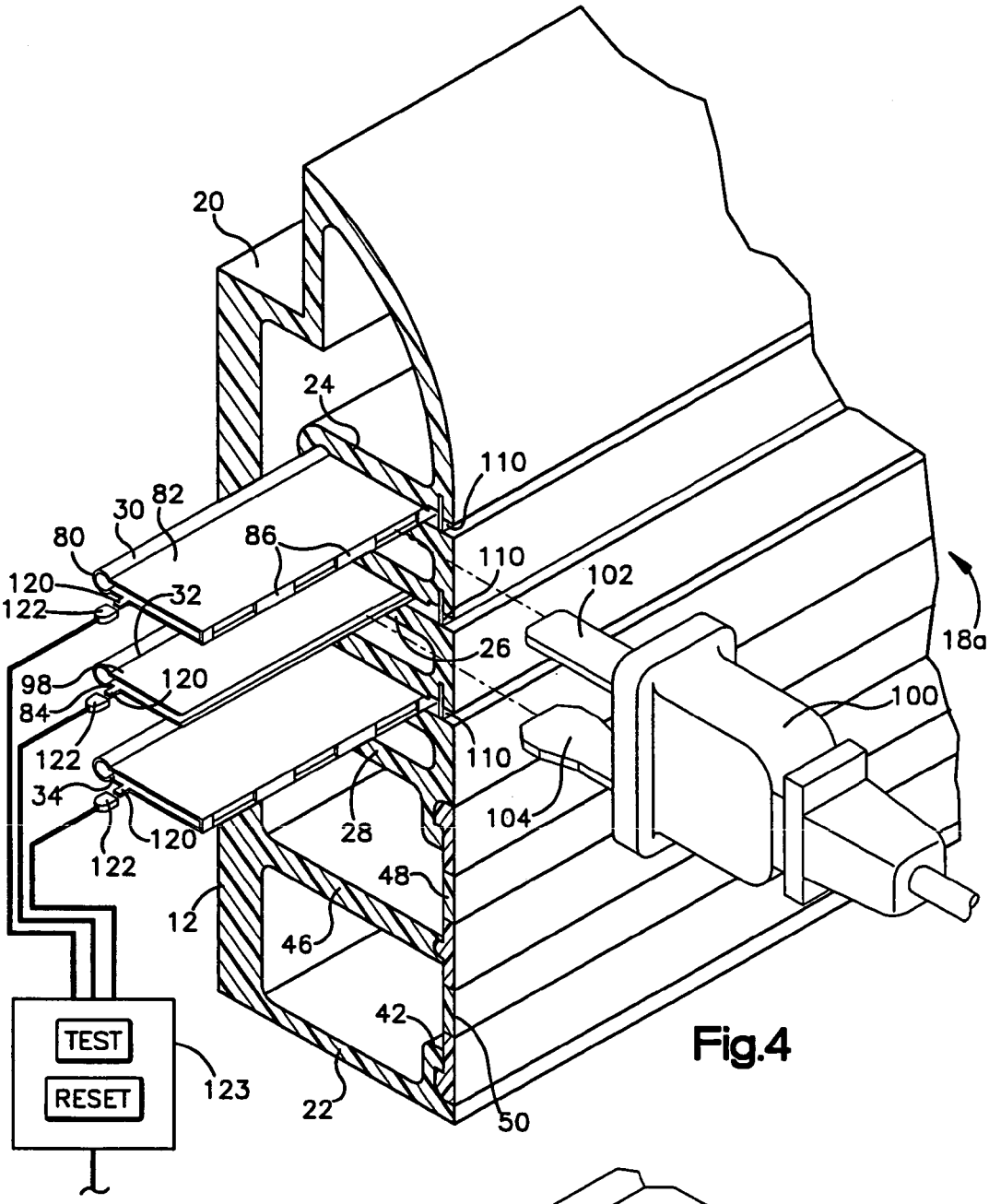
FIG. 4 is a cut-away exploded perspective view of the baseboard of FIG. 1.
Figure 4A:
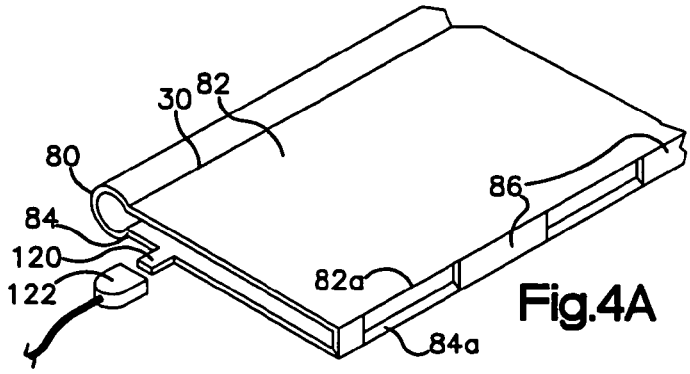
FIG. 4*a* is a perspective view of a conductor according to the present invention.

In one illustrated embodiment in FIG. 4, a three-channel configuration is contemplated. In the three channel configuration, the upper channel 24 houses a conductor 30, the middle channel 26 houses the conductor 32 and the lower channel 28 houses a conductor 34 which is of the same configuration as the conductor 30 (i.e., polarized conductor). The semi-circular ends 80 of the conductors 30, 32, 34 are accommodated by the semi-circular portions 24*a*, 26*a*, 28*a* of the channels 24, 26, 28. The conductors 30, 32, 34 slide into the channels 24, 26, 28 from the side of the baseboard 10 such that the semi-circular ends 80 of the conductors 30, 32, 34 are housed within the semi-circular portion of the channels. The upper and lower arms of the conductors 30, 32, 34 further extend into the channel in a direction toward the outer portion 18*a* of the front face 18. The diameter of the semi-circular regions of the conductors 30, 32, 34 is larger than the width of the channels 24, 26, 28. Due to this arrangement, the conductors cannot be pulled out of the channels 24, 26, 28 of the baseboard 10 through the front face. As such, when a plug 100 is inserted into the channels 24, 26, 28 and further unplugged, the prongs 102, 104 of the plug 100 will not pull the conductors 30, 32, 34 out of their respective locations in channels 24, 26, 28.

Figure 2:
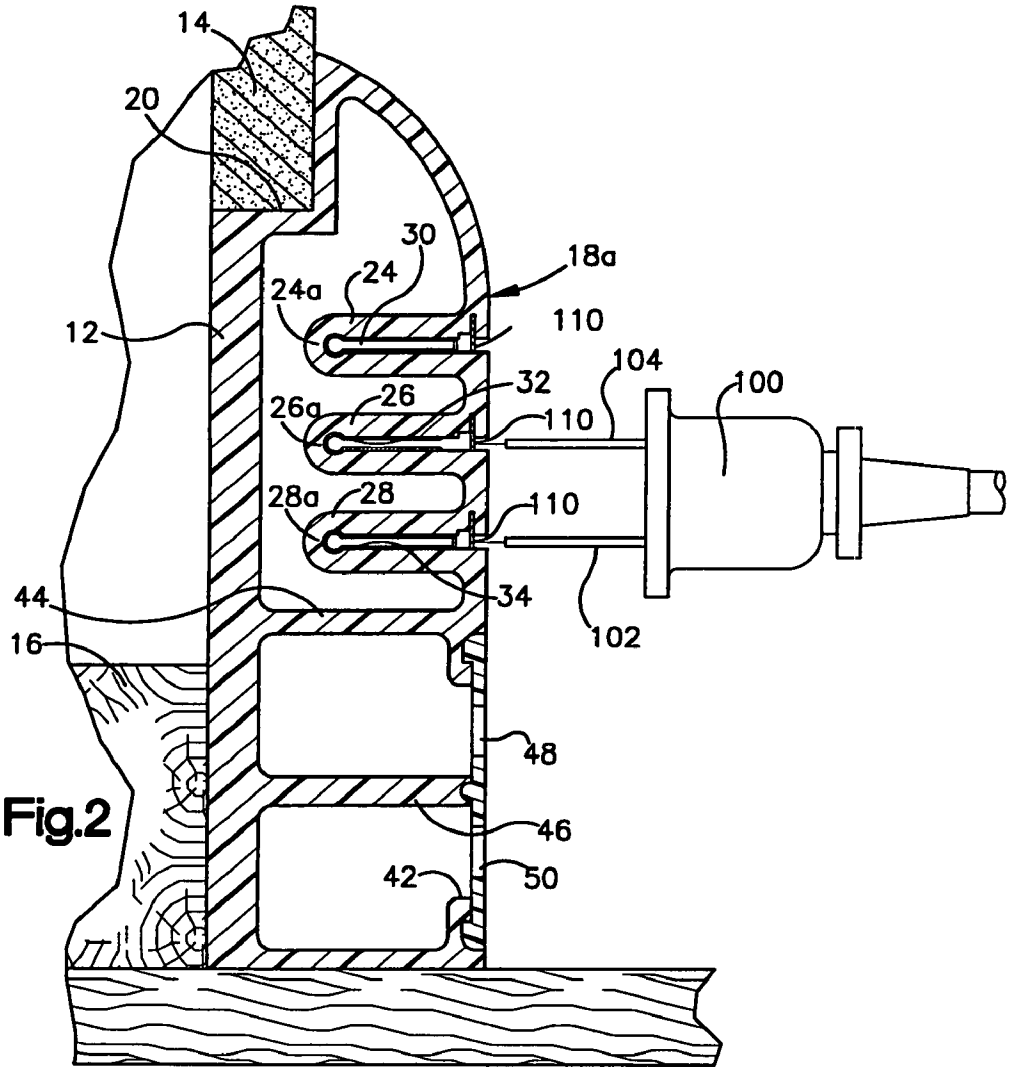
FIG. 2 is a cross-sectional view of the baseboard of FIG. 1.

FIG. 2 illustrates the inventive baseboard 10 prior to the insertion of a polarized two-prong plug 100. The polarized plug includes a large prong 104 and a small prong 102. Each channel 24, 26, 28 includes a rubber guard 110 at the insertion end of the channel along the surface of the outer face 18*a* of the front plate 18. The guard 110 prevents foreign objects from entering the channels 24, 26, 28 and adds to the aesthetic value of the baseboard 10. As shown in FIG. 2, the guards 110 cover the opening to the channels 24, 26, 28 prior to insertion of the prongs 102, 104 of the plug 100. The guards 110 are comprised of an upper end 110*a* and a lower end 110*b*. The upper end 110*a* is affixed in the body of the front plate 18. The lower end 110*b* extends out of the front plate 18 and covers the width of the channel. When a plug 100 is inserted, as in FIG. 3, the lower end 110*b* is forced back towards the channel and take a position that is non-interfering with the prongs 102, 104 of the plug 100.

In the illustrated embodiment of FIGS. 1–4, the top channel 24 houses a polarized conductor 30. The middle channel 26 houses a non-polarized conductor 32 and the bottom channel houses a polarized conductor 34. Each conductor 30, 32, 34 includes a tab 120 which connects to an electrical supply via a sleeve 122 (see FIG. 4). The sleeve 122 slides over the tab 120 for connecting the each conductor 230, 32, 34 to a protector 123 prior to being in communication with a power supply. The protector is a surge or ground fault interrupt (GFI) protector or a combination of both a surge and GFI protector. Any standard surge or GFI protector may be employed as know to those of ordinary skill in the art.

The conductor 30, a polarized conductor, housed in channel 24 is connected to an electrical supply and is always in a constant "hot" state with a non-ground potential. The conductor 32, a non-polarized conductor, housed in channel 26 is a neutral conductor and the conductor 34, a polarized conductor, housed in channel 28 is controlled by a switch (not shown) such as a wall switch. As noted, the polarized conductors 30, 34 will only accept the small prong on a polarized plug. When a plug is "plugged in" to the top two channels 24, 26 with the smaller prong in plugged into channel 24 housing conductor 30, electricity is continuously available for the apparatus connected to the plug 100. When a switched connection is needed, the plug 100 is rotated 180° such that the prongs 102, 104 occupy the bottom two channels 26, 28 where channel 28 houses the polarized conductor 34 and channel 26 houses a neutral conductor 34, electricity is not available to the plug unless the switch is activated.

Figure 3:
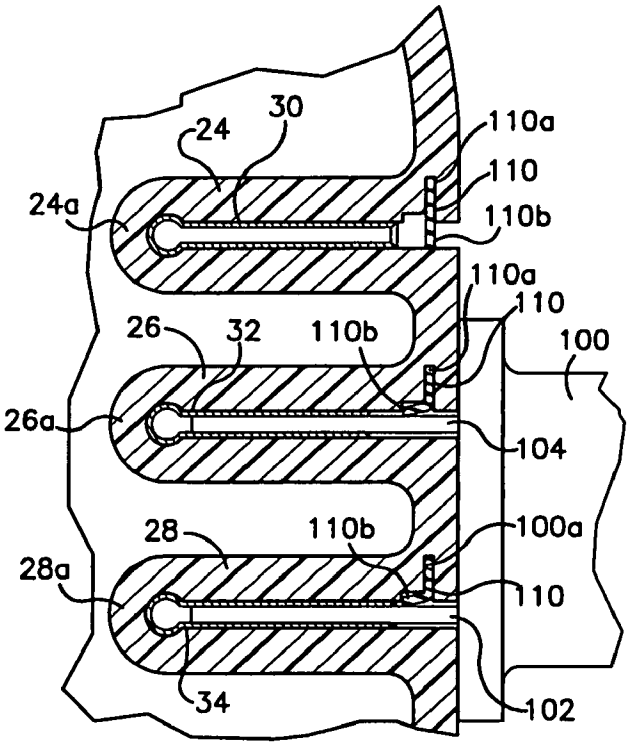
FIG. 3 is an exploded view of the cross-section of FIG. 2 showing a plug in the inserted position.

FIG. 3 shows the plug 100 in the "plugged in" state. When the plug enters the channels 26, 28, it pushes back the guards 110, particularly the lower end 110*b* of the guards 110 to a non-interfering position. The prongs 102, 104 are further urged into the channels 26, 28 until the plug 100 is in a fully "plugged in" state. In this state, the prongs 102, 104 make firm contact with the conductors 34, 32, respectively. The prongs 102, 104 do not extend to the end of the channels 26, 28 but rather extend in the channels 26, 28 far enough that it can make contact with the conductors 32, 34. Further, the conductors 30 and 34 extend further away from the back plate 12 so that if a plug's polarity is reversed there will be no contact.

The front plate 18 also includes an upper opening 40 and a lower opening 42 which expose the hollow center of the baseboard 10. The upper opening 40 exposes a hollow cavity defined by an upper wall 44 at the top, the back plate 12 to the back, a partition 46 to the bottom and a first front panel 48 to the front. The lower opening 42 exposes a second cavity which is defined at the top by the partition 46, the back plate 12 to the rear, the lower extension 22 to the bottom and a second front panel 50 to the front. These cavities may house other conduits such as telephone wires, television cable and/or networking cable or other cable or wire as apparent to one of ordinary skill in the art.

Figure 5:
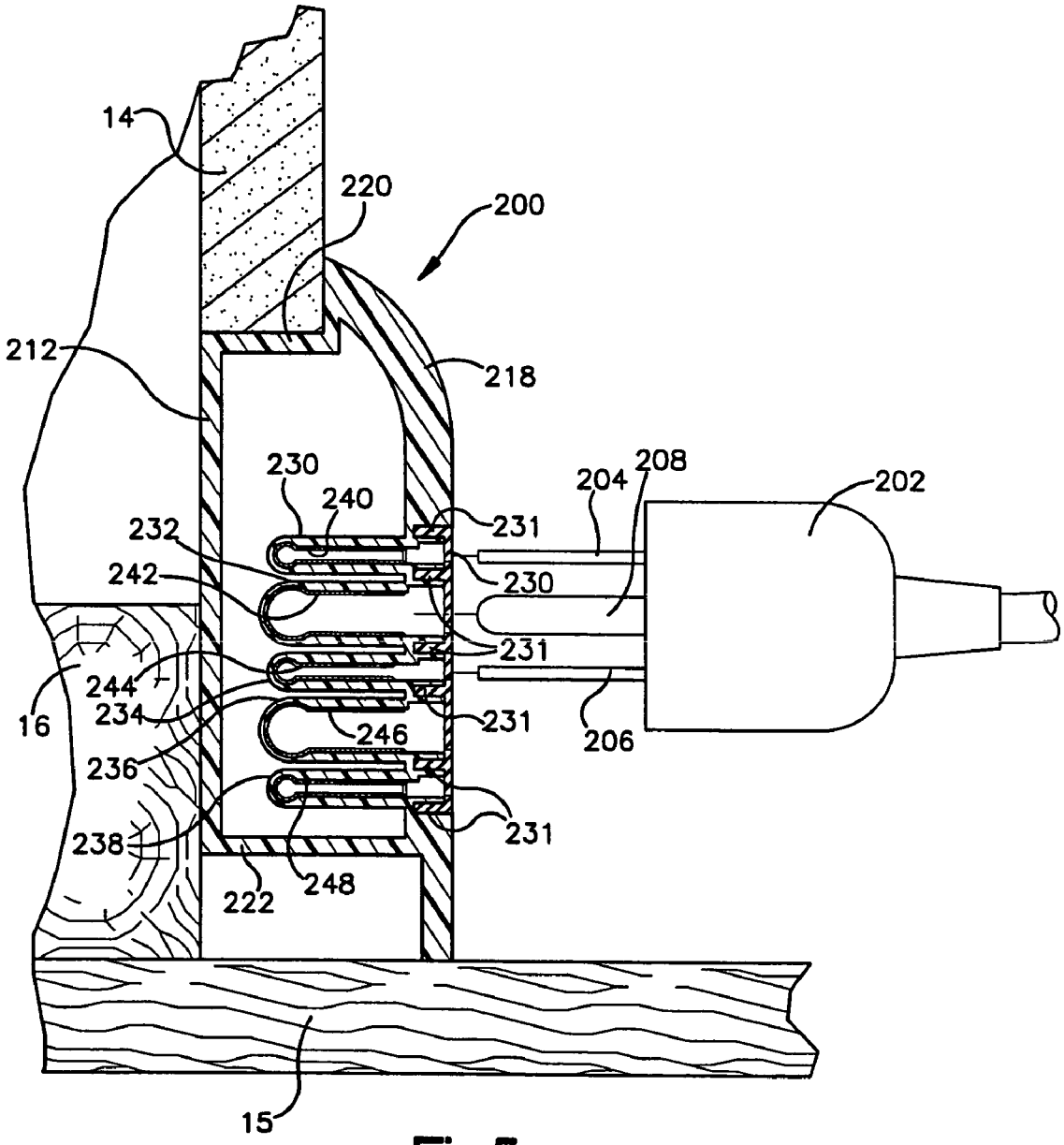
FIG. 5 is a cross-sectional view of an alternative embodiment of the present invention.

Turning now to FIG. 5, a baseboard 200 according to the present invention which can accommodate a 3-prong plug 202 is shown. The 3-prong plug 202 includes a small prong 204, a larger prong 206 and a ground prong 208. Like the three-channel baseboard 10, the five-channel baseboard 200 includes a back plate 212 which may be fastened to a wall or wall studding 16. An upper extension 220 extends away from the back plate 212 in a generally perpendicular direction. In the illustrated embodiment of FIG. 5, the back plate 212 does not extend to the floor but rather ends at the lower extension 222. The lower extension 222 extends away from the back plate in a generally perpendicular direction. A front plate 218 connects the upper extension 220 to the lower extension 222. Further, the front plate 218 extends beyond the lower extension 222 to the floor 15. This creates a void defined by the wall studding 16 to the back, the lower extension 222 to the top, the floor 15 to the bottom and the front plate 218 to the front. This void can be used to as a conduit for other cables.

The front plate has extruded therein five depression or channels 230, 232, 234, 236, 238 which house conductors 240, 242, 244, 246, 248, respectively. The configuration and interaction of the channels with the conductors is the same as described for the three-channel baseboard. The five-channel baseboard 200 allows the use of a three-pronged plug. The two upper channels 230, 232 and middle channel 234 are employed when continuous access to electricity is needed. Channel 230 houses a polarized conductor 240, as described above, which accepts the smaller prong on a three-prong polarized plug 202. The conductor 230 is in a constant "hot" state with a non-ground potential. Channel 232 housed conductor 242 which is a ground conductor. Although this conductor accommodates the ground prong 208 it is of the same configuration as the polarized and non-polarized conductor described earlier. Channel 234 houses the non-polarized conductor 244 which accommodates the larger prong 206 on a polarized plug 202. The conductor 244 can accommodate the prong 206 at any point along its length. Whereas, the polarized conductor 240 accommodates the smaller prong 204 in the slots created by the flanges 86 as described earlier.

Where a switched connection is needed, the plug is rotated 180° such that the smaller prong 204 is inserted into channel 238 housing the polarized conductor 248. This conductor 248 is switch controlled. The ground prong 208 is then inserted in channel 236 which houses ground conductor 246. Finally, the larger prong 206 is again inserted into channel 244.

The baseboard 200 also includes a rubber guard plate 230 having rubber protrusions 231 that extend into the face plate 218 of the baseboard 200. The rubber guard plate 230 covers a region of the front plate 218 which encompasses the channels 240, 242, 244, 246, 248. The guard 230 includes a slits at the portion which of the guard 230 that covers a channel 240, 242, 244, 246, 248. When the plug 202 is to be plugged in, the prongs slide through the slits separating the rubber far enough to allow the prongs of the plug 202 to enter their respective channel. When the prongs of the plug 202 are removed from the channels, the rubber guards return to a position that will prevent foreign objects from entering the channels. As is stated with the three-prong embodiment, the polarized conductors 240 and 248 extend further from the back plate 212 than the non-polarized conductor 244 to prevent accidental contact where the polarity of the plug 202 is reversed and there is an attempt to insert the plug 202 in the reversed fashion. Further, a surge or GFI protector can be employed in the five-prong embodiment as described with the three-prong embodiment.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

I claim:

1. For use with an elongated electrical baseboard molding system that is installed along a wall surface, a baseboard comprising:

a front face generally parallel to the wall surface;

a plurality of elongated narrow channels formed in the front face, wherein said channels extend inwardly towards the wall, wherein each channel includes a bus conductor insert having a pair of spaced apart conducting surfaces in electrical communication with each other wherein the conducting surfaces are maintained in spaced relationship at a separation distance that provides a friction fit with a prong of an electrical plug and wherein at least one of the bus conductor inserts further includes an entry face surface that is generally parallel to the wall surface and accessible through an entrance to the narrow channel and defines a row of slots along the length of the channel that are sized to permit insertion of a smaller prong of a polarized electrical plug while preventing insertion of a larger prong of a polarized electrical plug; and wherein said conductor bus inserts are in electrical communication with one or more sources of alternating current.

2. The baseboard of claim 1 further including an intermediary channel between two the channels and wherein the intermediary channel includes a bus conductor insert having conducting surfaces spaced apart a distance to provide a friction fit with a center prong of a three prong electrical plug.

3. The baseboard of claim 1 further comprising conduit channels integral to the baseboard and positioned between the front face of the baseboard and the wall.

4. The baseboard of claim 1 including a surge protector disposed between one or more of the current sources and one or more of the bus conductor inserts.

5. The baseboard of claim 1 including a ground fault interrupt protector disposed between one or more of the current sources and one or more of the bus conductor inserts.

6. The baseboard of claim 1 including a top channel, a middle channel, and a bottom channel and wherein the top and bottom channel have bus conductor inserts with entry face surfaces including slots that are sized to permit insertion of a smaller prong of a polarized electrical plug while preventing insertion of a larger prong of a polarized electrical plug.

7. The baseboard of claim 6 wherein the middle channel includes a face surface that is a continuous slot that runs the length of the channel.

8. The baseboard of claim 1 wherein at least one bus conductor insert is in communication with a switched current source.

9. The baseboard of claim 8 wherein the switch is a kick switch that is mounted on the baseboard.

10. The baseboard of claim 1 further comprising flexible channel guards that cover the channels beyond the entry surface of the bus conductor inserts.

11. The baseboard of claim 10 wherein the flexible channel guards include slits that correspond in location to the slots on the entry surface.

12. For use with an elongated electrical baseboard molding system that is installed along a wall surface, a baseboard comprising:

a front face generally parallel to the wall surface;

a plurality of elongated narrow channels formed in the front face, wherein said channels extend inwardly towards the wall, wherein each channel includes a bus conductor and has a receptacle end that is adapted to receive a prong of an electrical plug and further wherein at least one of the bus conductors has a constant non-ground potential; and wherein said conductors are in electrical communication with an electrical energy supply.

13. The baseboard of claim 12 wherein the channels extend for substantially the entire length of the baseboard.

14. The baseboard of claim 12 wherein the baseboard is comprised of extruded plastic.

15. The apparatus of claim 12 further comprising guards which cover the receptacle end of the channels and which are placed in a non-interfering position upon entry of a prong of a plug into the receptacle end of the channels.

16. The baseboard of claim 12 wherein at least one of the bus conductors is in communication with a switch.

17. The baseboard of claim 12 wherein a protector exists between the power supply and the conductors, said protector being selected from the group consisting of a surge protector and a ground fault interrupt (GFI) protector.

18. The baseboard of claim 12 wherein the front face includes three channels including, a first channel having a first bus conductor being switch-controlled, a second channel having a second bus connector being a ground conductor and a third channel having a third bus connector possessing a non-ground potential.

19. The apparatus of claim 18 wherein the channel including a switch-controlled bus connector is comprises polarized slots which accommodate a smaller prong on a polarized plug.

20. The apparatus of claim 18 wherein the channel including a bus conductor having a non-ground potential that is comprised of polarized slots which accommodate a smaller prong on a polarized plug.

21. The apparatus of claim 12 further comprising conduit channels.

22. The apparatus of claim 21 wherein said conduit channels are adapted to house phone and cable wires.

23. The apparatus of claim 12 wherein the front face includes five channels wherein a first channel includes a bus conductor that is switched-controlled, a second channel including a second bus conductor being a ground conductor, a third channel including a third bus conductor that is a neutral conductor, a fourth channel including a forth bus conductor that is a ground conductor and a fifth channel including a fifth bus conductor having a constant non-ground potential.

24. The apparatus of claim 23 wherein the channels housing the switched bus conductor and the constant non-ground potential bus conductor are comprised of slots which accommodate a smaller prong on a polarized plug.

* * * * *